US010023001B2

(12) United States Patent
Philippe et al.

(10) Patent No.: US 10,023,001 B2
(45) Date of Patent: Jul. 17, 2018

(54) METHOD FOR MANUFACTURING A MULTILAYER DATA MEDIUM WITH REFLECTING METALLISED INSCRIPTIONS

(71) Applicant: FASVER, Baillargues (FR)

(72) Inventors: Eric Philippe, Eyguieres (FR); Laurence Bes, Jacou (FR); Anthony Gallo, Argelliers (FR)

(73) Assignee: FASVER, Baillargues (FR)

( * ) Notice: Subject to any disclaimer, the term of this patent is extended or adjusted under 35 U.S.C. 154(b) by 3 days.

(21) Appl. No.: 15/318,250

(22) PCT Filed: Jun. 12, 2015

(86) PCT No.: PCT/EP2015/063180

§ 371 (c)(1),
(2) Date: Dec. 12, 2016

(87) PCT Pub. No.: WO2015/189393

PCT Pub. Date: Dec. 17, 2015

(65) Prior Publication Data

US 2017/0120663 A1 May 4, 2017

(30) Foreign Application Priority Data

Jun. 13, 2014 (FR) ..... 14 55407

(51) Int. Cl.
*B42D 15/00* (2006.01)
*B42D 25/455* (2014.01)
(Continued)

(52) U.S. Cl.
CPC ..... *B42D 25/455* (2014.10); *B42D 25/21* (2014.10); *B42D 25/337* (2014.10);
(Continued)

(58) Field of Classification Search
CPC ..... G03H 2250/10; G03H 1/0011; G03H 1/0248; G03H 1/0252; G03H 2240/50; G03H 2250/12
(Continued)

(56) References Cited

U.S. PATENT DOCUMENTS 6,495,295 B1 * 12/2002 Shioda ..... G03H 1/0252 359/2
7,141,336 B2 * 11/2006 Shioda ..... G03H 1/0252 156/234
(Continued)

FOREIGN PATENT DOCUMENTS

WO 2010/125316 A1 11/2010
WO 2012/176126 A1 12/2012

OTHER PUBLICATIONS

International Search Report, dated Aug. 17, 2015, from corresponding PCT Application.

*Primary Examiner* — Shin H Kim
(74) *Attorney, Agent, or Firm* — Levenfeld Pearlstein, LLC

(57) ABSTRACT

Disclosed is a method for manufacturing a multilayer data medium having reflecting metallized inscriptions (23) visible from at least one outer surface (11). A basic pattern (24) is imprinted onto a transparent impression layer (21), the pattern being selected so as to be able to receive the inscriptions (23), to be transparent and to have a surface tension of more than 40 dynes/cm and a smooth surface condition with specular reflection of more than 50% measured according to the ISO 2813 standard at an angle of 60°, and no glass-transition temperature in the rolling temperature range; then the inscriptions (23) are imprinted in contact with the basic pattern (24), and then hot rolling under pressure of a stack including the impression layer (21) is carried out.

20 Claims, 1 Drawing Sheet

Figure 1A:
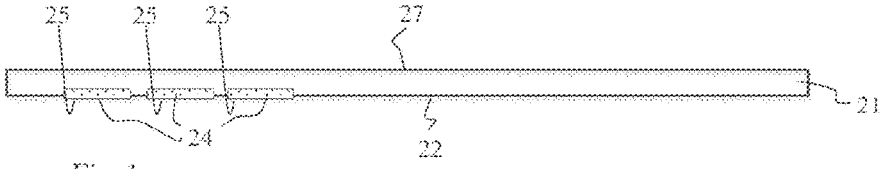

(51) Int. Cl.

| | |
|---|---|
| ***B42D 25/351*** | (2014.01) |
| ***B42D 25/46*** | (2014.01) |
| ***B42D 25/373*** | (2014.01) |
| ***B42D 25/21*** | (2014.01) |
| ***B42D 25/337*** | (2014.01) |

(52) U.S. Cl.
CPC ..... *B42D 25/351* (2014.10); *B42D 25/373* (2014.10); *B42D 25/46* (2014.10)

(58) Field of Classification Search
USPC ..... 283/91; 359/2
See application file for complete search history.

(56) References Cited

U.S. PATENT DOCUMENTS

| | | | | |
|---|---|---|---|---|
| 7,846,520 | B2 * | 12/2010 | Azakami | B31D 1/021 359/1 |
| 8,526,086 | B2 | 9/2013 | Trantoul et al. | |
| 2003/0124436 | A1 * | 7/2003 | Shioda | G03H 1/0252 430/1 |
| 2004/0247832 | A1 * | 12/2004 | Koops | G09F 3/0292 428/156 |
| 2006/0005918 | A1 * | 1/2006 | Azakami | B31D 1/021 156/230 |
| 2008/0088859 | A1 * | 4/2008 | Depta | B42D 25/41 358/1.7 |
| 2010/0277778 | A1 | 11/2010 | Trantoul et al. | |
| 2011/0156382 | A1 * | 6/2011 | Uyttendaele | B41M 3/14 283/91 |

* cited by examiner

METHOD FOR MANUFACTURING A MULTILAYER DATA MEDIUM WITH REFLECTING METALLISED INSCRIPTIONS

The invention relates to a method of manufacturing a multilayer data medium by hot rolling under pressure of a stack of a plurality of superimposed layers comprising at least one layer of at least one thermoplastic material, said multilayer data medium having inscriptions, named reflecting metallised inscriptions, having a metallic appearance, being at least partially reflective and visible from at least one outer surface of the multilayer data medium, said hot rolling being effected in a temperature range, named rolling temperature range. It extends to the medium thus obtained, to use thereof for the manufacture of an official document, and to an official document thus obtained.

Official documents are documents which, by reason of their nature and/or the rights which they can confer, must be protected against attempted forgery and/or counterfeiting and/or to guarantee authentication and/or to guarantee the integrity thereof (i.e. the fact that they have not been tampered with or modified). These documents can be in particular passports, visas, identity cards, driving licences, log books, bank cards, loyalty cards, bank cheques, diplomas, certificates, transport documentation, access control cards, badges, labels, legal documents, contracts, legal registers, land registry documents, trust documents, bank notes, manufacturing drawings or other drawings . . . . Official documents can have inscriptions, such as variable personalising details (first name, surname, address, photo, signature . . . of a holder or parties . . . ) and/or common details (security patterns, character boxes, borders, field names, seals, holograms, signatures, values, . . . ).

Throughout the text, "inscription" designates any sign or pattern produced on a layer of a document, able to be read by a human and/or a machine (OCR), at least under certain conditions (in particular under normal lighting with visible light; and/or under specific lighting; and/or after activation of an electronic device (screen) or the like . . . ). This may include in particular variable personalising details (first name, civil status, photograph, value, dates . . . ) of a official document or common and/or security details; texts (manually written or printed characters); codes (ASCII, universal codes which are read optoelectronically such as bar codes . . . ); holograms, drawings, images or photographs; spots or blocks of colour . . . . Official documents generally contain inscriptions, named security inscriptions, to render reproduction or forgery thereof impossible or extremely complex. These security inscriptions can be of the type which are visible in the visible range by simply looking with the naked eye (first-level security); or of the type which can be checked using a specific device such as an ultraviolet lamp (second-level security); or of the type which can be checked only in a certified laboratory (third-level security).

Throughout the text, "paper" designates any sheet obtained by a wet method using a suspension of natural cellulose fibres and/or mineral fibres and/or vegetable fibres and/or polymeric synthetic fibres other than cellulose, able to contain various fillers and additives such as are used in paper-making. The term "synthetic paper" designates any paper comprising polymeric synthetic fibres other than cellulose.

Throughout the text, the term "optically superimposed" designates layers or portions of layers disposed facing one another such that a ray of light passing through one of them passes through the others. Two layers or portions of layers which are optically superimposed can be physically superimposed in contact with one another, or separated by separating layers or portions of separating layers.

Throughout the text, the term "at least substantially" indicates, in a conventional manner, that a structural or functional feature does not have to be understood to be marking a sudden discontinuity, which would have no physical sense, but covers not only this structure or this function but also slight variations in this structure or this function which, in the technical context in question, produce an effect of the same nature if not of the same degree. Moreover, the terms "including/comprising a/one" are synonyms for "including/comprising at least one".

Numerous official documents such as bank cards, identity cards, driving licences, cards for individual access to sites or public transport, passport pages, customs documents, visas, trust documents, bank notes . . . are formed of a multilayer data medium obtained by hot rolling of a plurality of layers of at least one material selected from the group of thermoplastic materials and synthetic papers comprising at least one layer of at least one thermoplastic material. In particular, numerous official documents are formed by hot rolling (temperature typically of the order of 150° C. to 200° C.) under pressure (typically of the order of $10^6$ Pa to $2 \cdot 10^6$ Pa) of a plurality of polycarbonate layers, a material also having numerous advantages in these applications (rigidity, durability, easy and reliable marking (variable inscriptions, security patterns . . . ), option to produce markings by laser radiation . . . ).

From an industrial point of view, it is important to be able to manufacture these multilayer data media in large batches, incorporating therein all the security inscriptions at the time of hot rolling under pressure and avoiding multiple successive steps and the use of complex, expensive tooling. However, the possibilities offered with respect to the security inscriptions with the data media manufactured by hot rolling under pressure are limited by a number of constraints:

- when the security inscriptions are produced before hot rolling under pressure they must themselves be resistant to said hot rolling under pressure and not affect the result thereof;
- it is possible to produce certain security inscriptions during hot rolling under pressure by specific prior steps and/or with specific tooling; however, in order to produce reflecting metallised inscriptions, this solution is extremely expensive (vacuum deposition of metal); moreover, the patterns which can be produced are relatively crude and thus easy to reproduce by counterfeiters.

There is a perceptible need to be able to incorporate reflecting metallised security inscriptions, in particular ones which can be coloured, to form first-level and second-level security features on such multilayer data media which are intended to form official documents. Such inscriptions which are both metallised and reflective are, on the one hand, complex to achieve by reason of the metallised nature thereof and, on the other hand, cannot be reproduced by simple optical reading (e.g. by a scanner or photocopy) owing to their reflecting nature. WO2010/125316 describes a metallised film and the method of manufacture thereof using a composition of metallised ink imprinted on a layer have specific surface characteristics. However, it proves to be the case that the use of such a reflecting metallised ink composition to form such security inscriptions on a layer of a multilayer data medium having the specific surface characteristics required by this document does not make it possible to obtain satisfactory results: after the hot rolling under pressure the reflecting metallised inscriptions completely lose their reflecting effect and/or are deformed and/or have a thickening of the width of the mark.

The invention thus aims to overcome these disadvantages by proposing a method of manufacturing a multilayer data medium which is hot rolled under pressure, and a data medium thus obtained, incorporating reflecting metallised inscriptions.

The invention aims more particularly to permit the production of reflecting metallised inscriptions of which at least a part has a mark width less than 500 μm, able to form first-level security features (mini-impressions visible to the naked eye) or second-level security features (micro-impressions having a mark width less than 200 μm not visible to the naked eye and requiring an enlarging instrument such as a magnifying glass). More particularly, the invention aims to permit the production of reflecting metallised inscriptions selected from guilloché, fine-line patterns and raster images.

In order to achieve this, the invention relates to a method of manufacturing a multilayer data medium by hot rolling under pressure of a stack of a plurality of superimposed layers comprising at least one layer of at least one thermoplastic material, said multilayer data medium having inscriptions, named reflecting metallised inscriptions, having a metallic appearance, being at least partially reflective and visible from at least one outer surface of the multilayer data medium, said hot rolling being effected in a temperature range, named rolling temperature range, characterised in that:

- one surface, named the impression surface, of at least one transparent layer, named the impression layer, of said stack is imprinted with a varnish composition in a pattern, named the basic pattern, selected to be able to receive said reflecting metallised inscriptions, said varnish composition being selected in order—after curing—to be transparent and to have:
  - a surface tension of more than 40 dynes/cm and a smooth surface condition with specular reflection of more than 50% measured according to the ISO 2813 standard at an angle of 60°,
  - no glass-transition temperature in the rolling temperature range, and in particular no glass-transition temperature lower than 200° C.,
- said reflecting metallised inscriptions are imprinted in contact with said basic pattern of said impression layer with a composition of metallised ink comprising a curable binder incorporating discrete particles, named reflecting metallised particles, in the general form of platelets dispersed in the curable binder having a grain size selected to form pigments having a metallic, at least partially reflecting, appearance,
- then said stack is formed, comprising said impression layer, said impression surface being opposite to said outer surface and having said reflecting metallised inscriptions applied thereto in contact with another adjacent layer of the stack,
- then this stack is hot rolled under pressure.

The invention also relates to a multilayer data medium obtained by a method according to the invention. It thus also relates to a multilayer data medium comprising a plurality of layers superimposed by hot rolling under pressure, in particular in a temperature range, named rolling temperature range, comprising at least one layer of at least one thermoplastic material, said multilayer data medium having inscriptions, named reflecting metallised inscriptions, having a metallic appearance, being at least partially reflective and visible from at least one outer surface of the multilayer data medium:

characterised in that said reflecting metallised inscriptions:

- are formed of an imprinted metallised ink comprising a cured binder incorporating discrete particles, named reflecting metallised particles, generally in the form of platelets dispersed in the binder with a grain size forming pigments having a metallic, at least partially reflecting, appearance,
- are imprinted in contact with a basic pattern imprinted on a transparent layer, named the impression layer, said basic pattern being formed of a transparent varnish having:
  - a surface tension of more than 40 dynes/cm and a smooth surface condition with specular reflection of more than 50% measured according to the ISO 2813 standard at an angle of 60°,
  - no glass-transition temperature lower than 200° C., i.e. no glass-transition temperature in the rolling temperature range.

In fact, it unexpectedly proves to be the case that choosing a varnish composition having no detectable (particularly by thermal differential analysis) glass-transition temperature in the rolling temperature range, and in particular a varnish composition having no detectable glass-transition temperature lower than 200° C., in order to form a basic pattern receiving reflecting metallised inscriptions, makes it possible to produce reflecting metallised inscriptions of very high quality, which can be extremely fine—in particular of a mark width of less than 200 μm, e.g. of the order of 100 μm to 150 μm—, without these losing either their fineness and quality or their reflecting nature or their metallic appearance after hot rolling under pressure implemented to form the multilayer data medium.

In an advantageous manner and in accordance with the invention, said rolling temperature range is lower than 200° C., in particular between 20° C. and 180° C. In particular, in an advantageous manner and in accordance with the invention, the maximum temperature of said rolling temperature range is lower than 200° C., in particular lower than or equal to 180° C., in particular in the case where the layers of said data medium are made of polycarbonate. Thus, in an advantageous manner and in accordance with the invention, the varnish composition forming said basic pattern has no detectable glass-transition temperature lower than the maximum temperature of said rolling temperature range.

Thus, in an advantageous manner and in accordance with the invention, at least a part of said reflecting metallised inscriptions is imprinted with a mark width less than 500 μm—in particular less than 200 μm—e.g. of the order of 100 μm to 150 μm. In particular, at least a part of the reflecting metallised inscriptions comprises patterns selected from guilloché, line patterns and raster images. Of course, there is nothing to prevent reflecting metallised inscriptions in accordance with the invention from being imprinted with a greater mark width, e.g. in the form of drawings, or in a block of colour on a surface portion of the impression surface, even over the entirety of this surface.

Furthermore, in an advantageous manner and in accordance with the invention, the reflecting metallised inscriptions are imprinted on the basic pattern with a peripheral overhang of the basic pattern with respect to the reflecting metallised inscriptions—in particular between 0.5 mm and 3 mm, e.g. of the order of 2 mm—about said reflecting metallised inscriptions.

Furthermore, in an advantageous manner and in accordance with the invention, the basic pattern has a format smaller than the format of the data medium. The basic pattern thus extends over only part of the surface of the impression layer.

Said impression layer protects the reflecting metallised inscriptions from the external environment. In particular, in some advantageous embodiments, the impression layer constitutes an outer layer of the multilayer data medium, forming said outer surface thereof.

Moreover, in an advantageous manner and in accordance with the invention, an impression layer of material selected from the group of transparent thermoplastic materials is used.

More particularly, in an advantageous manner and in accordance with the invention, an impression layer of a material selected from the group of transparent polycarbonates, transparent polyesters and transparent PVC is used.

Furthermore, in an advantageous manner and in accordance with the invention, said basic pattern is imprinted using a varnish composition selected from the group of ultraviolet-curing transparent acrylic varnishes and volatile solvent-based transparent varnishes containing acrylic binders and at least one curing agent. This varnish composition is also selected to be compatible with the impression layer and with the adjacent layer to which the impression layer is applied before and during hot rolling under pressure.

Moreover, in an advantageous manner and in accordance with the invention, in order to carry out imprinting of the reflecting metallised inscriptions, a metallised ink composition is used comprising reflecting metallised particles selected from vacuum-metallised pigments and reflecting metallic particles.

In an advantageous manner and in accordance with the invention, a composition of metallised ink is used, comprising reflecting metallised particles having an average grain size between 8 μm and 11 μm.

Any imprinting technique can be used to imprint the basic pattern and/or reflecting metallised inscriptions, in particular one selected from screen printing, photogravure, flexography, offset printing or the like.

In some advantageous embodiments, a multilayer data medium in accordance with the invention is formed of layers of at least one material selected from the group of thermoplastic materials and synthetic papers. In particular, a multilayer data medium in accordance with the invention can advantageously be formed by hot rolling under pressure of a plurality of layers of a thermoplastic material selected from among polycarbonates, PVCs, synthetic papers and mixtures and associations thereof.

The invention relates to an official document comprising a data medium in accordance with the invention, of which at least one outer surface has reflecting metallised inscriptions—in particular reflecting metallised inscriptions in accordance with at least one of the features mentioned above or below.

An official document in accordance with the invention can in particular be selected from the group formed by passports, passport pages, customs documents, visas, identity cards, driving licences, vehicle registration cards (log books), bank cards, loyalty cards, bank cheques, diplomas, certificates, transport documentation, access control cards, badges, labels, legal documents, contracts, legal registers, land registry documents, trust documents, bank notes, packages and manufacturing drawings.

The invention also relates to a method of manufacturing, a data medium and an official document, which are characterised in combination by all or some of the features mentioned above or below.

Figure 1B:
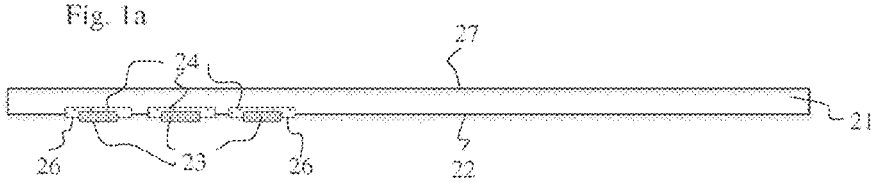
Figure 2:
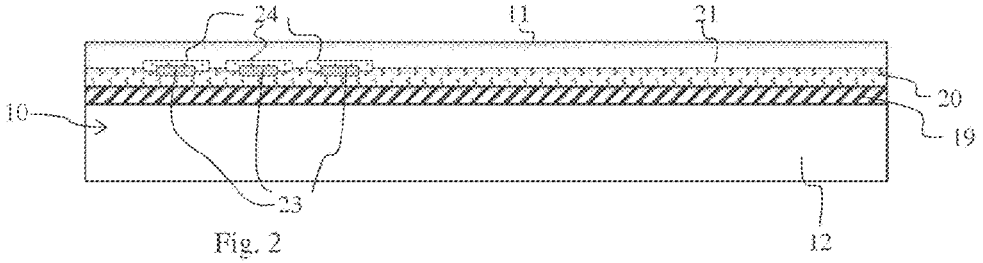
Figure 3:
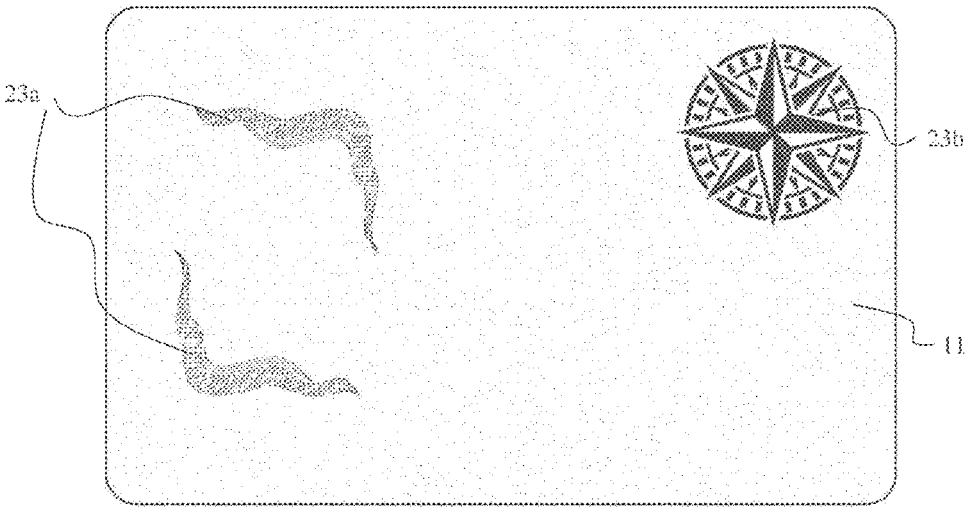

Other aims, features and advantages of the invention will become clear upon reading the following description of different embodiments of the invention given in a non-limiting manner and referring to the attached figures in which:

FIGS. 1*a* and 1*b* are schematic cross-sectional views of an impression layer of a multilayer data medium in accordance with the invention, respectively at the end of two steps of imprinting a basic pattern and reflecting metallised inscriptions, of a method in accordance with the invention, FIG. 2 is a schematic cross-sectional view of a multilayer data medium in accordance with the invention at the end of the hot rolling under pressure step of a method in accordance with the invention, FIG. 3 is a schematic top view of an example of a data medium in accordance with the invention.

In the figures, for the sake of illustration, the relative scales and dimensions have not been respected. In particular, the thicknesses are shown in an exaggerated fashion.

FIG. 2 shows an example of a data medium 10 in accordance with the invention at the end of a hot rolling under pressure step and ready for use, being suitable for undergoing personalising laser marking in order to obtain an official document in accordance with the invention. This data medium 10 is formed of a stack of a plurality of layers superimposed one on another and having been subjected to hot rolling under pressure. The majority of the layers are preferably formed of a thermoplastic material, in particular selected from among polycarbonates, PVCs, polyesters (polyethylene terephthalate PET, polyethylene terephthalate glycol PETG), and co-extruded films of polyester and polycarbonate (PEC). In some advantageous embodiments, in particular for applications of the bank card, identity card or transport card type, the data medium 10 is formed of a plurality of polycarbonate layers. There is nothing to prevent the data medium incorporating layers of different materials, including layers of a material other than a thermoplastic material, e.g. paper, more particularly synthetic paper. The total number of layers making up a data medium 10 in accordance with the invention is of no significance within the scope of the present invention.

The data medium 10 is in the general form of a sheet or card and thus has two opposing outer planar main surfaces and a relatively small thickness. Throughout the following, only a main surface, named the outer surface 11, is described and has the features of the invention, it being understood that the other outer, main surface can equally have the same features or, in contrast, can have other features. Consequently, it is assumed throughout the following that the surface opposite the outer surface 11 in question is an outer main surface of a base 12 illustrated in cross-section in FIG. 2, without this implying any limitation whatsoever, such a base 12 possibly not being present and/or itself being formed of a layer or a plurality of layers of various thicknesses, not described in this description.

In particular, the base 12 can be formed of at least one layer of thermoplastic material selected from among polycarbonates, PVCs, polyesters (polyethylene terephthalate PET, polyethylene terephthalate glycol PETG), co-extruded films of polyester and polycarbonate (PEC), synthetic papers (in particular selected from among the paper sold under the trade mark Teslin® by the company PPG, Monroeville, USA, the paper sold under the trade mark Neobond® by the company Neenah Lahnstein, Lahnstein, Germany, and the paper sold under the trade mark Polyart® by the company Arjobex, Boulogne, France). Other examples are possible.

The outer surface 11 of the data medium 10 has different markings representing information (common details) and/or constituting security markings intended to reinforce resistance to attempted forgery and/or to prevent reproduction by optical reading. The data medium 10 comprises in particular reflecting metallised inscriptions 23, i.e. in the example illustrated in FIG. 3, marking 23*a* in the form of guilloché, and marking 23*b* in the form of a compass dial. Of course, numerous other examples are possible.

In the embodiment illustrated in FIG. 2, the data medium 10 comprises, starting from the base 12:

- a basic layer 19 which can be formed e.g. by an opaque white block (contrasting with all the coloured, dark or black inscriptions optically superimposed on this basic layer on the side of the outer surface 11),
- a laser-marked sub-layer 20 sensitive to marking laser radiation, in particular infrared laser radiation, e.g. at 1064 nm, so as to permit the production of personalising marking in at least a part of the thickness of this laser-marked sub-layer 20 under the effect of this laser radiation applied from the outer surface 11,
- a transparent impression layer 21 placed overlapping and in contact with the whole of the surface of the laser-marked sub-layer 20. The outer surface 11 is formed by the impression layer 21.

The multilayer data medium 10 is manufactured by hot rolling under pressure of a stack of these different layers, the features of this lamination step being selected depending on the nature and features of the different constituent layers of the stack. For example, in the case where the different layers are formed of polycarbonate, the hot rolling under pressure can be effected in a rolling press under the following conditions:

1 min. rising to 180° C.
12 min. at 180° C. under 30 N/cm$^2$
5 min. at 180° C. under 150 N/cm$^2$
cooling to 26° C. for 17.5 min. under 180 N/cm$^2$.

Thus, this hot rolling under pressure has a rolling temperature range between 20° C. and 180° C. Of course, numerous other values and conditions for hot rolling under pressure are possible.

The laser-marked sub-layer 20 can extend in the form of a continuous block of colour in the format of the outer surface 11 (except for possible peripheral shrinkage); or, in contrast, it can be applied in the form of a plurality of distinct, separate portions, at least facing locations intended to receive laser marking, or only facing these locations. It can be formed of a thickness of a varnish imprinted with an ink composition incorporating a marking agent sensitive to the laser radiation and/or be selected from among the films sold in a state ready to be laser-marked, e.g. a film sold under the name Makrofol® ID 6-2 laserable by the company Bayer Materials Science, Leverkusen, Germany.

The reflecting metallised inscriptions 23 are produced by imprinting on a transparent basic pattern 24 which is itself imprinted on the impression layer 21 incorporated into a stack of layers used to form the multilayer data medium 10 by hot rolling under pressure.

The impression layer 21 can be formed e.g. by a transparent thermoplastic material, in particular selected from among polycarbonates, PVCs, polyesters (polyethylene terephthalate PET, polyethylene terephthalate glycol PETG), and co-extruded films of polyester and polycarbonate (PEC). The same is true of the various other constituent layers of the multilayer data medium 10.

The method of manufacturing the data medium 10 of FIG. 2 comprises the following successive steps.

In the first step shown in FIG. 1*a*, a transparent basic pattern 24 is imprinted on one surface, named the impression surface 22, of the two surfaces of the impression layer 21, with shapes and dimensions selected to be able to receive all the reflecting metallised inscriptions 23.

In a preferred manner, and taking account of the fact that the basic pattern 24 must have a peripheral overhang 26 around the reflecting metallised inscriptions 23, these inscriptions being able to be produced in the form of narrow lines, in particular micro-printing, the basic pattern 24 is preferably imprinted in the form of at least one block of colour in the format of an enclosing contour for each surface zone comprising reflecting metallised inscriptions 23. For example, when the reflecting metallised inscriptions 23 are guilloché patterns, the transparent basic pattern 24 is imprinted in the format of the enclosing contour of these guilloché patterns with a peripheral overhang 26 around this enclosing contour.

The basic pattern 24 is imprinted with a varnish composition permitting a transparent varnish finishing layer to be formed, having an extremely smooth surface 25 with high surface tension, i.e. free of surface flaws (such as an orange peel effect, fish eyes or pin holes) and adapted to have a surface tension of more than 40 dynes/cm and a smooth surface condition with specular reflection of more than 50% measured according to the ISO 2813 standard at an angle of 60°.

Furthermore, a varnish composition is selected which is free, after curing, of any glass-transition detectable by differential thermal analysis in said rolling temperature range.

In order to do this, it is possible to use an ultraviolet-drying varnish composition or acrylic solvent-based varnish composition, having more than 90% transparency and being very glossy, e.g. such as that sold under the name UVLG6 by the company Marabu (www.marabu-druckfarben.de). Other examples are possible since the varnish composition can be imprinted on the impression surface 22 of the impression layer 21, it is transparent, it has the surface condition mentioned above and no glass-transition temperature which can be detected in the rolling temperature range.

This layer of transparent varnish forming the basic pattern 24 can be tinted and/or cover a layer of tinted varnish previously produced (not shown in the figures), permitting the metallic effect obtained to be modified. In order to do this, it is possible to use an ultraviolet-drying transparent varnish composition such as mentioned above, in which 1% to 25% of an ultraviolet-drying ink, e.g. a yellow coloured ink or one such as sold by the company Tiflex (Poncin, France) under the reference 3*5559 is added. Of course, numerous other examples are possible.

In the second step, illustrated in FIG. 1*b*, the reflecting metallised inscriptions 23 are imprinted on the smooth surface 25 of the basic pattern 24. In order to do this, e.g. a composition of reflecting metallised ink as indicated e.g. by WO 2010/125316 or U.S. Pat. No. 8,526,086 is used. Thus a reflecting metallised ink composition is used, comprising a filler of reflecting metallised particles having a reflecting metallic appearance, dispersed in a curable binding composition which can be formed of a traditional transparent imprinting ink, e.g. a transparent solvent-based ink composition sold by the company Mistral Graphic (Carcassonne, France). The reflecting metallised ink layer is imprinted like a traditional ink layer, on the surface 25 of the varnish layer forming the pattern 24 from low to high surface tension and having a very smooth surface, in particular a surface tension of more than 40 dynes/cm and a smooth surface condition with specular reflection of more than 50% measured according to the ISO 2813 standard at an angle of 60°.

Said filler of reflecting metallised particles can incorporate particles generally in the form of platelets, e.g. in the form of petals, chips or shards, which have themselves previously been manufactured by vacuum metallisation. Such particles can be obtained by vacuum sublimation and metallic aluminium vaporisation on a medium such as a polyester film, the fine aluminium layer obtained then being detached from the medium then ground to the desired grain size, in particular between 8 μm and 11 μm, with a thickness of the order of 300 Angströms corresponding to that of the deposited aluminium layer.

As a variation, or in combination, the metallised particle filler can incorporate metallised particles selected from among the composition of metallised pigments sold under the name Xymara Metasheen® by the company Ciba (Basel, Switzerland), and the composition of metallised pigments sold under the name StarBrite® by the company Silberline (Leven, United Kingdom).

These reflecting metallised particles are used in sufficient quantity in the imprinting composition to obtain, depending on the imprinting process used, the desired reflecting effect after imprinting and curing. For example, in the case of screen printing, the quantity of metallised filler particles in the imprinting composition is between (proportions by volume) 5% and 15%, in particular of the order of 10%.

Such a layer of metallised ink is reflective and opaque and can as such have properties similar to those of vacuum deposition of metal. For example, it makes it possible to increase by the order of 80% the optical reflecting power of visible light of the film. However, it should be noted that the invention makes it possible to precisely adjust the reflection and opacity properties of this reflecting metallised ink layer according to different values depending on the application. By decreasing the quantity of the metallised particle filler, the reflectivity and opacity of the reflecting metallised inscriptions 23 is decreased. In contrast, by increasing the quantity of this filler, the reflectivity and opacity are increased.

In order to obtain a coloured mirror effect in the reflecting metallised inscriptions 23 it is possible to use an imprinting composition comprising a cured binder incorporating at least one dye which is soluble in organic solvents such as those sold by CIBA (Basel, Switzerland) under the name Ciba OROSOL.

A silver mirror effect is obtained without addition of dyes to the imprinting composition comprising the reflecting metallised particles. In order to obtain a golden appearance, yellow-orange-tinted dyes are used; in order to obtain a chrome-like appearance, blue-tinted dyes are used; in order to obtain a nickel-like appearance, green-tinted dyes are used; and in order to obtain a copper-like appearance, red-orange-tinted dyes are used.

Furthermore, the reflecting metallised particles have average dimensions suitable for permitting imprinting according to the chosen imprinting method with the precision and quality required. In an advantageous manner, the metallised particles have an average grain size between 8 μm and 11 μm with, in the case of platelets, a thickness of the order of 300 Angströms.

Moreover, it is noted that the imprinting of a layer of reflecting metallised ink comprising a filler of reflecting metallised particles in the general form of platelets on the surface 25 of the basic pattern 24 which is very smooth and has high surface tension causes, in spite of the very small dimensions of these reflecting metallised particles, the spontaneous coating of the different particles in parallel with the surface, considerably increasing the reflecting effect obtained. In this way, for the same optical effect, it is possible to reduce the filler quantity of metallised particles, which facilitates the operations involving the imprinting of the reflecting metallised inscriptions 23.

The reflecting metallised inscriptions 23 can be produced at least in part with a very high level of fineness, in particular with a mark width less than 500 μm—preferably less than 200 μm—e.g. of the order of 100 μm to 150 μm.

Furthermore, as indicated above, the reflecting metallised inscriptions 23 are imprinted with the provision of a peripheral overhang 26 of the basic pattern 24 around the reflecting metallised inscriptions 23, i.e. preferably around an enclosing contour thereof. This peripheral overhang 26 is e.g. between 0.5 mm and 3 mm, in particular of the order of 2 mm.

The imprinting of the basic pattern 24 and that of the reflecting metallised inscriptions 23 can be effected by any imprinting technique, e.g. one selected from screen printing, photogravure, flexography, offset printing or the like.

At the end of this second imprinting step, a layer formed by the transparent impression layer 21 is obtained, bearing the basic pattern 24 and the reflecting metallised inscriptions 23 as shown in FIG. 1*b*. This layer can be used in a stack subjected to hot rolling under pressure to form the multilayer data medium 10, in the manner of any other layer of this stack.

In the example illustrated in FIG. 2, the different layers 12, 19, 20 and 21 are stacked one on another with the laser-marked sub-layer 20 interposed between the basic layer 19 and the impression layer 21, and are hot rolled under pressure in a rolling press, the total thickness of the stack decreasing by about 10%, to obtain the multilayer data medium 10 as shown in FIG. 2, ready for use in order to undergo personalising marking by laser radiation.

It is noted that the reflecting metallised inscriptions 23 are visible, as seen from the outer surface 11 through the thickness of the transparent impression layer 21 and through the transparent basic pattern 24, with a very pleasing reflecting and metallised effect.

The invention makes it possible in particular to forgo any vacuum metallisation step, and the impression layer 21 can be any thermoplastic material covering layer of a multilayer data medium 10 without itself having to have specific surface features (surface tension, surface condition . . . ). It will suffice for the impression layer 21 to permit imprinting of the basic pattern 24 with transparent varnish.

EXAMPLE 1

On one of the surfaces of two sheets of polycarbonate, 100 μm in thickness, of the trade mark Makrofol® ID 6-2 sold by the company Bayer Materials, Leverkusen, Germany, a basic pattern 24 is imprinted using a transparent varnish sold under the reference UVLG6 by the company MARABU (France) in the format of the enclosing contour of the reflecting metallised inscriptions 23 to be produced in accordance with FIG. 3, with a peripheral overhang (not shown in FIG. 3, the varnish being transparent) of 2 mm of the basic pattern 24 all around this enclosing contour. The layer of varnish of the basic pattern 24 is imprinted with a screen printing screen produced from a fabric with a mesh size of 150 threads/cm, the threads having a diameter of 34 μm.

A glass-transition temperature measurement by differential thermal analysis does not permit a glass-transition temperature of the basic pattern 24 thus formed to be detected after curing thereof.

After curing of the basic pattern 24, the reflecting metallised inscriptions 23 are imprinted with a reflecting metallised ink composition sold under the reference 3Y2656 by the company Tiflex (Poncin, France). In order also to obtain a coloured reflecting metallised effect, 2% to 10% of dye are added to this reflecting metallised ink composition.

The reflecting metallised inscriptions 23 are imprinted with a screen printing screen made of a fabric of which the mesh size comprises 120 threads/cm, the threads being of a diameter of 34 μm. The guilloché 23*a* is formed by lines having a width between 100 μm and 150 μm.

It should be noted that the metallised inscriptions 23 thus imprinted are reflective, seen by transparency from the side of the surface of the polycarbonate sheets which is opposite to the impression surface 22 but that the free surfaces thereof seen from the same side as the impression surface 22 are not reflective.

The imprinted polycarbonate sheets are associated with three other polycarbonate sheets interposed between the imprinted polycarbonate sheets so as to form a stack, the imprinted surfaces being placed in contact with the underlying sheets of the stack, i.e. not constituting outer surfaces thereof. The five polycarbonate sheets forming, with the two imprinted sheets, said stack are successively the following: a sheet of 200 μm white polycarbonate, a sheet of 200 μm white polycarbonate; a sheet of 200 μm white polycarbonate.

The sheet assembly forming this stack is rolled in a rolling press under the following conditions:

1 min. rising to 180° C.

12 min. at 180° C. under 30 N/cm$^2$ 5 min. at 180° C. under 150 N/cm$^2$ cooling to 26° C. for 17.5 min. under 180 N/cm$^2$.

A multilayer data medium 10 is obtained in the form of a card, the total thickness of which is equal to the sum of the thicknesses of the polycarbonate sheets used, decreased by about 10%.

It is noted that the reflecting metallised inscriptions 23 retain their metallised and reflecting appearance as seen from the side of the outer surface 11 of the multilayer data medium 10 and that their fineness is in no way adversely affected by the hot rolling under pressure. No smudging or other deformation is perceived.

COMPARATIVE EXAMPLE 2

The same method as in example 1 above is carried out, replacing the varnish composition forming the basic pattern 24 with a varnish composition sold under the name Ultraflex® by the company Marabu (France, www.marabu.com). After curing, this varnish has a surface condition suitable for receiving the reflecting metallised inscriptions but a glass-transition temperature Tg between 20° C. and 60° C., detectable by differential thermal analysis.

After hot rolling under pressure of the different constituent layers of the stack, it is noted that the multilayer data medium obtained has reflecting metallised inscriptions but with deformation and thickening of the lines.

COMPARATIVE EXAMPLE 3

The same method as in example 1 above is carried out, replacing the varnish composition forming the basic pattern 24 with a varnish composition sold under the name Marastar® SR by the company Marabu (France, www.marabu.com). After curing, this glossy varnish has a surface condition suitable for receiving the reflecting metallised inscriptions but a glass-transition temperature Tg between 55° C. and 65° C., detectable by differential thermal analysis.

After hot rolling under pressure of the different constituent layers of the stack, it is noted that the multilayer data medium obtained has reflecting metallised inscriptions but with deformation and thickening of the lines.

COMPARATIVE EXAMPLE 4

The same method as in example 1 above is carried out but without using the basic pattern 24, the reflecting metallised inscriptions 23 being directly imprinted on sheets of a polycarbonate film such as that sold under the name Makrofol® ID1-4 by the company Bayer MaterialScience (Leverkusen, Germany). These polycarbonate sheets have a smooth surface with specular reflection of more than 98% measured according to the ISO 2813 standard at an angle of 60° and a surface tension of more than 40 dynes/cm.

After imprinting and curing the reflecting metallised inscriptions on these polycarbonate sheets with the same composition of reflecting metallised ink as in example 1 and incorporation thereof into the stack then hot rolling under pressure of the different constituent layers of the stack, it is noted that the metallised inscriptions have lost their reflecting effect.

It goes without saying that the invention can cover numerous variant embodiments and applications other than those described above and illustrated in the figures. In particular, the reflecting metallised inscriptions 23 can be used in different forms and in different applications including to produce holographic patterns.

The invention claimed is:

1. Method of manufacturing a multilayer data medium by hot rolling under pressure of a stack of a plurality of superimposed layers comprising at least one layer of at least one thermoplastic material, said multilayer data medium having inscriptions, named reflecting metallised inscriptions, having a metallic appearance, being at least partially reflective and visible from at least one outer surface of said multilayer data medium, said hot rolling being effected in a temperature range, named rolling temperature range, wherein:

one surface, named impression surface, of at least one transparent layer, named impression layer, of said stack is imprinted thereon with a varnish composition in a pattern, named the basic pattern, selected to be able to receive said reflecting metallised inscriptions, said varnish composition being selected in order—after curing—to be transparent and to have:

a surface tension of more than 40 dynes/cm and a smooth surface condition with specular reflection of more than 50% measured according to the ISO 2813 standard at an angle of 60°, no glass-transition temperature in the rolling temperature range, said reflecting metallised inscriptions are imprinted in contact with said basic pattern of said impression layer with a composition of metallised ink comprising a curable binder incorporating discrete particles, named the reflecting metallised particles, in the general form of platelets dispersed in the curable binder having a grain size selected to form pigments having a metallic, at least partially reflecting, appearance, then said stack is formed, comprising said impression layer, said impression surface being opposite to said outer surface and having said reflecting metallised inscriptions applied thereto in contact with another adjacent layer of the stack, then this stack is hot rolled under pressure.

2. Method according to claim 1, wherein at least a part of said reflecting metallised inscriptions is imprinted with a mark width less than 500 μm.

3. Method according to claim 1, wherein an impression layer is used, being of a material selected from the group of transparent thermoplastic materials and transparent synthetic papers.

4. Method according to claim 1, wherein an impression layer is used, being of a material selected from the group of transparent polycarbonates, transparent polyesters and transparent PVC.

5. Method according to claim 1, wherein said basic pattern is imprinted using a varnish composition selected from the group of ultraviolet-curing transparent acrylic varnishes and volatile solvent-based transparent varnishes containing acrylic binders and at least one curing agent.

6. Method according to claim 1, wherein a metallised ink composition is used, comprising reflecting metallised particles selected from vacuum-metallised pigments and reflecting metallised particles.

7. Method according to claim 1, wherein a metallised ink composition is used, comprising reflecting metallised particles having an average grain size between 8 μm and 11 μm.

8. Method according to claim 1, wherein reflecting metallised inscriptions are imprinted on the basic pattern with a peripheral overhang of the basic pattern with respect to the reflecting metallised inscriptions.

9. Multilayer data medium comprising a plurality of layers superimposed by hot rolling under pressure, comprising at least one layer of at least one thermoplastic material, said multilayer data medium having inscriptions, named reflecting metallised inscriptions, having a metallic appearance, being at least partially reflective and visible from at least one outer surface (11) of the multilayer data medium:

wherein said reflecting metallised inscriptions:

are formed of an imprinted metallised ink comprising a cured binder incorporating discrete particles, named reflecting metallised particles, generally in the form of platelets dispersed in the binder with a grain size forming pigments having a metallic, at least partially reflecting, appearance, are imprinted in contact with a basic pattern, the basic pattern imprinted on a transparent layer, named impression layer, said basic pattern being formed of a transparent varnish having:

a surface tension of more than 40 dynes/cm and a smooth surface condition with specular reflection of more than 50% measured according to the ISO 2813 standard at an angle of 60°, no glass-transition temperature lower than 200° C.

10. Medium according to claim 9, wherein at least a part of said reflecting metallised inscriptions has a mark width less than 500 μm.

11. Medium according to claim 9, wherein at least a part of said reflecting metallised inscriptions has a mark width less than 200 μm.

12. Medium according to claim 9, wherein said impression layer is of a material selected from the group of transparent thermoplastic materials and transparent synthetic papers.

13. Medium according to claim 9, wherein said impression layer is of a material selected from the group of transparent polycarbonates, transparent polyesters and transparent PVC.

14. Medium according to claim 9, wherein layers of the plurality of layers are formed of at least one material selected from the group of thermoplastic materials and synthetic papers.

15. Official document comprising a data medium according to claim 9, of which at least one outer surface has reflecting metallised inscriptions.

16. Method according to claim 2, wherein an impression layer is used, being of a material selected from the group of transparent thermoplastic materials and transparent synthetic papers.

17. Method according to claim 2, wherein an impression layer is used, being of a material selected from the group of transparent polycarbonates, transparent polyesters and transparent PVC.

18. Method according to claim 3, wherein an impression layer is used, being of a material selected from the group of transparent polycarbonates, transparent polyesters and transparent PVC.

19. Method according to claim 2, wherein said basic pattern is imprinted using a varnish composition selected from the group of ultraviolet-curing transparent acrylic varnishes and volatile solvent-based transparent varnishes containing acrylic binders and at least one curing agent.

20. Method according to claim 3, wherein said basic pattern is imprinted using a varnish composition selected from the group of ultraviolet-curing transparent acrylic varnishes and volatile solvent-based transparent varnishes containing acrylic binders and at least one curing agent.

* * * * *